United States Patent [19]

Gabor et al.

[11] Patent Number: 4,678,355

[45] Date of Patent: Jul. 7, 1987

[54] PRINT TIP CONTACT SENSOR FOR QUIET IMPACT PRINTER

[75] Inventors: Andrew Gabor, Alamo; John C. Dunfield, San Jose; George W. Bowers, Jr., Hayward; Richard G. Crystal, Los Altos, all of Calif.

[73] Assignee: Xerox Corporation, Stamford, Conn.

[21] Appl. No.: 751,349

[22] Filed: Jul. 2, 1985

[51] Int. Cl.[4] ..... B41J 9/36; B41J 1/30

[52] U.S. Cl. ..... 400/389; 400/144.2; 400/157.2; 400/166; 400/385; 400/388.1; 400/689; 400/703; 101/93.19; 101/93.29; 101/93.48

[58] Field of Search ..... 101/93.03, 93.18, 93.19, 101/93.28, 93.29, 93.30, 93.31, 93.32, 93.33, 93.34, 93.48; 400/163.2, 157.3, 166, 388, 388.1, 391.4, 392, 703, 144.2, 157.2, 689, 385, 389

[56] References Cited

U.S. PATENT DOCUMENTS

| | | | |
|---|---|---|---|
| 1,846,339 | 2/1932 | Joerissen | 400/385 |
| 1,998,555 | 4/1935 | Norton | 400/388.1 |
| 2,139,700 | 12/1938 | Slavin | 400/388.1 |
| 2,875,879 | 3/1959 | Auerbach | 400/389 |
| 3,217,853 | 11/1965 | Gentilini | 400/388 |
| 3,628,644 | 12/1971 | Cralle, Jr. et al. | 400/166 |
| 4,192,230 | 3/1980 | Blom et al. | 101/93.03 |
| 4,220,085 | 9/1980 | Scholte et al. | 101/316 |
| 4,347,786 | 9/1982 | Sweat, Jr. et al. | 400/166 X |
| 4,429,342 | 1/1984 | Heider | 101/93.29 |
| 4,525,086 | 6/1985 | Field et al. | 400/166 X |
| 4,547,087 | 10/1985 | Heider et al. | 400/157.2 |

FOREIGN PATENT DOCUMENTS

| | | | |
|---|---|---|---|
| 0028539 | 5/1981 | European Pat. Off. | 400/144.2 |
| 63784 | 11/1982 | European Pat. Off. | 400/157.2 |
| 3330563 | 3/1985 | Fed. Rep. of Germany | 400/134 |
| 1141300 | 12/1962 | German Democratic Rep. | 400/389 |
| 1274137 | 8/1968 | German Democratic Rep. | 400/389 |
| 40265 | 3/1985 | Japan | 400/388 |

OTHER PUBLICATIONS

"Print Hammer Position Sensor"; W. D. Freeman et al; *IBM Tech. Disc. Bull.;* vol. 18, No. 12, p. 4072; May 1976.

"Type Bar Velocity Transducer"; H. W. Simpson; *IBM Tech. Disc. Bull.;* vol. 2, No. 1, p. 37; Jun. 1959.

S. A. Oleksa; *Transducer for Measuring Print Impact Force;* IBM Tech. Disc. Bull.; vol. 22, No. 11, pp. 5019-5020; Apr. 1980.

IBM Technical Disclosure Bulletin, "Print Hammer Impact Force Detection and Correction", by Matthews, vol. 21, No. 12, May. '79, p. 4763.

IBM Technical Disclosure Bulletin, "Multi-Function Impact Detector for Impact Printer", by Hindermeyer, vol. 27, No. 6, Nov. '84, p. 3345.

*Primary Examiner*—Edgar S. Burr
*Assistant Examiner*—David A. Wiecking
*Attorney, Agent, or Firm*—Serge Abend

[57] ABSTRACT

An impacting element for an impact printer having a platen, selectable character elements and means for driving the impacting element to impart a printing force to a selected character element, to drive it against said platen for a contact period, the impacting element including a sensor thereon for generating a signal indicative of the initiation of the contact period.

4 Claims, 5 Drawing Figures

PRINT TIP CONTACT SENSOR FOR QUIET IMPACT PRINTER

FIELD OF THE INVENTION

This invention relates to a sensor for determining the "moment of arrival" of the print tip of an impact mechanism of an improved serial impact printer designed to substantially reduce impact noise generation during the printing operation.

BACKGROUND OF THE INVENTION

The office environment has, for many year, been the home of objectionable noise generators, viz, typewriter and high speed impact printers. Where several such devices are placed togehter in a single room, the cumulative noise pollution may even be hazardous to the health nd well being of its occupants. The situation is well recognized and has been addressed in the technical community as well as in governmental bodies. Attempts have been made to reduce the noise by several methods: enclosing impact printers in sound attenuating covers; designing impact printers in which the impact noise is reduced; and designing quieter printers based on non-impact technologies such as ink jet and thermal transfer. Also, legislative and regulatory bodies have set standards for maximum acceptable noise levels in office environments.

Typically, impact printers generate an average noise in the range of 70 to just over 80 dBA, which is deemed to be intrusive. When reduced to the 60–70 dBA range, the noise is construed to be objectionable. Further reduction of the ipact noise level to the 50–60 dBA range would improce the designation to annoying. Clearly, it would be desirable to reduce the impact noise to a dBA value in the low to mid-40's. The "A" scale, by which the sound values have been identified, represents humanly perceived levels of loudness as opposed to absolute values of sound intensity and will be discussed in more detail below. When considering sound energy represented in dB (or dBA) units, it should be borne in mind that the scale is logarithmic and that a 10 dB difference mans a factor of 10, a 20 dB difference means a factor of 100, 30 dB a factor of 1000 and so on. We are looking for a very aggressive dropoff in printer impact noise.

The printing noise referenced above is of an inpulse character and is primarily produced as the hammer impacts and drives the type character pad against the ribbon, the print sheet and the platen with sufficient force to release the ink from the ribbon. The discussion herein will be directed solely to the impact noise that masks other nosies in the system. Once such impact noise has been substantially reduced, the other noses will no longer be extraneous. Thus, the design of a truly quiet printer requires the designer to address reducing all other noise sources, such as those arising from carriage motion, character selection, ribbon lift and advance, as well as from miscellaneous clutches, solenoids, motors and switches.

Since it is the impact noise which is modified in the present invention, it is necessary ot understand the origin of the impact noise in conventional ballistic hammer impact printers. In such typical daisywheel printers, a hammer mass of about 2.5 grams is driven ballistically by a solenoidactuated clapper; the hammer hits the rear surface of the character pad and impacts it against the ribbon/paper/platen combination, from which it rebounds to its home position where is must be stopped, usually by another impact. This series of impacts is the main source of the objectionable noise.

Looking solely at the platen deformation impact, i.e. the hammer against the ribbon/paper/platen combination, the total dwell time is typcially in the vicinity of 100 microseconds. Yet, at a printing speed fo 30 characters per second, the mean time available between character impacts is about 30 milliseconds. Clearly, there is ample opportunity to significantly stretch the impact dwell time to a substantially larger fraction of the printing cycle than is typical of conventional printers. For instance, if the dwell time were stretched from 100 microseconds to 6 to 10 milliseconds, this would represent a sixty- to one hundred-fold increase, or stretch, in pulse width relative to the conventional. By extending the deforming of the platen over a longer period of time, an attendant reduction in noise output can be achieved, as will become apparent in the following discussion.

The general concept—reduction in impulse noise by stretching the deformation pule—has been recognized for many decades. As long ago as 1918, in U.S. Pat. No. 1,261,751 (Anderson) it was recognized that quiet operation of the printing fucntion in a typewriter may be achieved by increasing the "time actually used in making the impression". Anderson uses a weight or "momentum accumulator" to thrust each type carrier against a platen. Initially, the force applying key lever is struck to set a linkage in motion for moving the type carriers. Then the key lever is arrested in its downward motion by a stop, so that it is decoupled from the type carried and exercises no control thereafter. An improvement over the Anderson actuating linkage is taught in Going, U.S. Pat. No. 1,561,450. A typewriter operating upon the principles described in these patents was commercially available.

Pressing or squeezing mechanisms are also shown and described in U.S. Pat. No. 3,918,568 (Shimodaira) and U.S. Pat. No. 4,147,438 (Sandrone et al) wherein rotating eccentric drives urge pushing members against the character/ribbon/sheet/platen combination in a predetermined cyclical manner. It should be apparent that an invariable, "kinematic" relationship (i.e. fixed interobject spacings) between the moving parts renders critical importance to the platen location and tolerances theron. That is, if the throat distance between the pushing member and the platen is too great, the ribbon and the sheet will not be pressed with sufficient force (if at all) for acceptable print quality and, conversely, if the throat distance is too close, the pushing member will cause the character pad to emboss the image receptor sheet. Sandrone et al teaches that the kinematic relationship may be duplicated by using a solenoid actuator, rather than a fixed eccentric (not alternative embodiment of FIGS. 14 through 17). Pressing action may also be accomplished by simultaneously moving the platen and the pushing member, as taught in U.S. Pat. No. 4,203,675 (Osmera et al).

In addition, Sandrone et al states that quiet operation relies upon moving a small mass and that noisy operation is generated by large masses. This theory is certainly in contravention to that applied in Anderson and Going (supra) and in U.S. Pat. No. 1,110,346 (Reisser) in which a mass multiplier, in the form of a flywheel and linkage arrangement, is set in motion by the key levers to increase the effective mass of the striking rod which impacts a selected character pad.

A commercially acceptable printer must have a number of attributes not found in the prior art. First, it must be reasonably priced; therefore tolerance control and the number of parts must be minimized. Second, it must have print quality comparable to, or better, than that conventionally available. Third, it must have the same or similar speed capability as conventional printers. The first and the last factors rule out a printer design based upon squeeze action since tolerances are critical therein and too much time is required to achieve satisfactory print quality.

It is the primary object of the present invention to provide a novel impacting element for a quiet impact printer that is orders of magnitude quidter than that typical in today's marketplace, and which nevertheless achieves the rapid action and modest cost required for office usage.

SUMMARY OF THE INVENTION

The quiet impact printer of the present invention comprises, in one form, a platen, selectable character elements, and a novel impacting element for inparting a printing force to a selected character element, to drive it against the platen for a contat period. The impacting element is provided with a sensor thereon for generating a signal indicative of the initiation of the contact period.

THEORY OF OPERATION OF THE INVENTION

As is the case in conventioal ballistic hammer printers, the improved printer of this invention also is based upon the principle of kinetic energy transfer from a hammer assembly to a deformable member. The mass is accelerated, gains momentum and transfers its kinetic energy to the deformable member which stores it as potential energy. In such dynamic systems the masses involved and speeds related to them are substantial, so that one cannot slow down the operation without seeing a significant change in behavior. Taken to its extreme, if such a system is slowed enough its behavior disappears altogether and no printing will occur. In other words, a kinetic system will only work if the movable mass and its speed are in the proper relationship to one another.

Another attribute of the kinetic system is that it is self levelling. By this we mean that the moving mass is not completely limited by the drive behind it. Motion is available to it and the moving mass will continue to move until an encounter with the platen is made, at which time the exchange between their energies is accomplished. Therefore, since the point of contact with the platen is unpredictable, spatial tolerances are less critical, and the printing action of the system will not be appreciably altered by minor variations in the location of the point of contact.

Kinetic energy transfer systems are to be distinguished from kinematic systems in which the masses involved and the speeds related to them are much less important. The latter are typically represented by cam-operated structures in which the moving elements are physically constrained in an invariable cyclical path. They will operate as effectively at any speed. It doesn't matter how slowly the parts are moved. All that is important is the spatial relationship between the relatively movable parts. The cycle of operation will continue unchanged even in the absence of the deformable member. Consider the effect of a platen spacing which is out of tolerance. If the platen is too close, the invariant motion will cause embossing of the paper; if the platen is too far, printing will not be of satisfactory quality, or printing may not take place at all.

In order to understand the theory by which noise reduction has been achieved in the novel impact printer of this invention, it would be helpful to consider the mechanism by which sound (impulse noise) is generated and how the sound energy can be advantageously manipulated. In a fundamental sense, sound results from a mechanical deformation which moves a transmitting medium, such as air. Since we will want to maintain the amplitude of platen deformation substantially the same as in conventional ballistic impact printers in order to insure high quality printing, we will only consider the velocity of the deformation. As the deforming surface moves, the air pressure changes in its vicinity, and the propagating pressure disturbance is perceived by the ear as sound. Immediately adjacent the surface there will be a slight rarefaction (or compression) of the transmitting medium, because the surronding air can fill the void (or move out of the way) only a finite rte, i.e., the faster the deformation occurs, the greater will be the disturbance in the medium. Thus, the resulting pressure difference and the resulting sound intensity depend upon deformation velocity, not merely upon amplitude of deformation. Intuitively we know that a sharp, rapid impact will be noisy and that a slow impact will be less noisy. As the duration of the deforming force pulse is increased, the velocity of the deforming surface is reduced correspondingly and the sound pressure is reduced. Therefore, since the intensity of the sound waves, i.e. the energy created per unit time, is proportional to the product of the velocity and pressure, stretching the deforming pulse reduces the intensity of the sound wave.

Taking this concept as our starting point, we consider the impact noise source, i.e. the platen deformation when hit by the hammer. The intervening character, ribbon, and paper will be neglected since they travel as one with the hammer. It has just been explained that sound intensity can be reduced by stetching the contact perior, or dwell, of the impact. We also know that we have a substantial time budget (about 15 milliseconds) for expanding the conventional (100 microsecond) contact period by a factor of about 100. Furthermore, it is well know that manipulation of the time domain of the deformation will change the frequency domain of the sound waves emanating therefrom. In fact, as the impulse deformation time is stretched, the sound frequency (actually, a spectrum of sound frequencies) emanating from the deformation is proportionately reduced. In other words, in the above example, stretching the contact period by 100 times would reduce the corresponding average frequency of the spectrum by 100 times.

As the deformation pulse width is increased and the average frequency and frequency spectrum is reduced, the impact printing noise is lessened as the result of two phenomena. The first phenomenon has been described above, namely, reduction of the sound wave intensity, arising from the proportionality of sound pressure to the velocity of the deformation. A reduction factor of about 3 dB per octave of average frequency reduction, has been calculated. The second phenomenon, arises from the psychoacoustic perception of a given sound intensity. It is well know that the human ear has an uneven response to sound, as a function of frequency. For very loud sounds the response of the human ear is almost flat with frequency. But, at lower loudness levels the human ear responds more sensitively to sound frequencies in the 2000 to 5000 Hz range, than to either higher or lower frequencies. This "roll-off" in the response of the human ear is extremely pronounced at both the high and low frequency extremes.

A representation of the combined effect of the sound intensity and the psychoacoustic perception phenomena is illustrated in FIG. 1 wherein there is reproduced the well known Fletcher-Munson contours of equal loudness (dBA), plotted against intensity level (dB) and frequency (Hz) for the average human ear. The graph has been taken from page 569 of "Acoustical Engineering" by Harry F. Olson published in 1957 by D. Van Nostrand Company, Inc. At 1000 Hz, the contours, which represent how the frequencies are weighted by the brain, are normalized by correspondence with intensity levels (i.e. 10 dB=10 dBA, 20 dB=20 dBA, etc.). As sstated above, both dB and dBA are logarithmic scales so that a difference of 10 dB means a factor of 10; 20 dB means a factor of 100; 30 dB means a factor of 1000, and so on.

The following example illustrates the above described compound reduction in perceived impulse noise achieved by expansion of the dwell time of the impact force. Consider as a starting point the vincity of region "a" in FIG. 1 which represents a conventional typewriter or printer impact noise level generated by an impact pulse of about 100 microseconds. It has a loudness level of about 75 dBA at a frequency of about 5000 Hz. An expansion of the impact dwell time to about 5 milliseconds represents a 50-fold dwell time increase, resulting in a comparable 50-fold (about 5.5 octaves) frequency reduction to about 100 Hz. This frequency shift is shown the line indicated by arrow A. A reduction factor of about 3 dB per octave, attributed to the slower deformation pulse, decreases the noise intensity by about 16.5 dB, along the line indicated by arrow B, to the vicinity of region "b" which falls on the 35 dBA contour. Thus, by stretching the impact time, the sound intensity per se has been decreased by about 16.5 dB, but the shift in the average frequency (to about 100 Hz) to a domain where the ear is less sensitive, results in the compound effect whereby impact noise is perceived to be about 40 dB quieter than conventional impact printers.

In order to implement the extended dwell time, with its attendant decrease in deformation velocity, it was found to be desirable to alter the impacting member. The following analysis, being a satisfactory first order approximation, willa ssist in understanding these alterations. For practical purposes, the platen, which generates noise duirng the deformation impact, may be considered to be a resilient deformable member having a spring constant "k". In reality it is understood that the platen is a viscoelastic material which is hightly temperature dependent. The platen (spring) and impacting hammer mass "m" will move together as a single body during the deformation period, and may be viewed as a resonant system having a resonant frequency "f" whose pulse width intrinsically is decided by the resonant frequency of the platen springiness and the mass of the hammer. In a resonant system, the resonant frequency is proportional to the square root of k/m (or $f^2=k/m$). Therefore, since the mass is inversely proportional to the square of the frequency shift, the 50-fold frequency reduction of the above example would require a 2500-fold inrease in the hammer mass. This means, that in order to achieve print quality (i.e. same deformation amplitude) comparable to the conventional ballistic-type impact printer it would be necessary to increase the mass of the typical hammer weighing 2.5 grams, to about 13.75 pounds. The need to control such a large hammer mass, while keeping the system inexpensive, would appear to be implausible.

Having seen that it is necessary to materially increase the mass, it is quickly understood that the quantitative difference we have effected is no longer one of degree, but is rather one of kind, signifying an entirely different, and novel, calss of impact mechanism. The novel approach of the present invention makes the implausible quite practical. Rather than increasing the hammer mass per se, a mass transformer is utilized to achieve a mechanical advantage and to bring a large effective, or apparent, mass to a print tip through a unique drive arrangement. In addition to an increase in the magnitude of the effective mass, quality printing is achieved by the metering of sufficient energy to the platen to cause the appropriate deformation therein.

In the impact printer of the present invention, a heavy mass is set in motion to accumulate momentum, for delivery to the platen by the movable print tip, through a suitable linkage. The entire excursion of the print tip includes a throat distance of about 50 mils from its home position to the surface of the platen and then a deformation, or penetration, distance of about 5 mils. The stored energy, or momentum, in the heavy mass is transferred to the platen during deformation and is completely converted to potential energy therein, as the print tip is slowed and then arrested. As the print tip is the only part of the kinetic energy delivery system "seen" by the platen, it views the print tip as having the large system mass (its effective mass). It should be apparent, of course, that relative motion between the print tip and the platen may be accomplished alternatively, by moving either the platen realtive to a fixed print tip, or by moving both the print tip and the platen toward and away from one another.

In the preferred form of the present invention, the total kinetic energy may be metered out incrementally to the mass transformer. A first portion of the energy will move the print tip rapidly across the throat distance and a second portion of the energy will be provided at the initiation of the deformation period. By controlling the prime mover, the traverse of the throat distance may be accomplished by initially moving the print tip rapidly and then slowing it down immediately before it reaches the platen surface. This maybe done by having regions of different velocity with transitions therebetween or it could be done by continuously controlling the velocity. It is desirable to slow the print tip to a low or substantially zero velocity immediately prior to the initiation of contact in order to decrease the impact noise. However, since its velocity at the initiation of contact would be too low for printing, an augmentation of kinetic energy must be imparted at that point in order to accelerate the print tip into the platen for accomplishing the printing.

Alternatively, it is possible to provide the mass transformer with the total kinetic energy it will need to cross the throat distance and to effect penetration of the platen. This energy would be metered out to the mass transformer by the system prime mover at the home position (i.e. prior to the initiation of the deformation period) and will set the mass transformer in motion. In order to carry out this procedure, a large force would have to be applied and it is apparent that more noise will be generated.

A major benefit may be obtained when we bifurcate the total kinetic energy and meter it for (a) closing down the throat distance (before contact), and (b) effecting penetration into the platen (after contact). Namely, the contact velocity will be low, resulting in inherently quieter operation. The metering may be accomplished so that the velocity of the print tip may be substantially arrested immediately prior to contact with the platen, or it may have some small velocity. What is important is that upon dertermination that contact has been made, an augmentation force is applied for adequate penetration.

We find that under certain conditions the application of the augmentation kinetic energy allows us to obtain the same penetration force and yet substantially decrease the effective mass, and thus the system mass. In order to understand why this is possible, the effect of momentum on deformation should be explored. In the following two examples, it is assumed that the same maximum platen deformation is effected, in order that comparable print quality is achieved. First consider a squeeze-type printer wherein the deforming force is applied so slowly that its momentum is negligible. As the print tip begins to deform the platen, its force is greater than, and overcomes, the platen restoring counterforce. When the print tip deforming force equals the platen restoring counterforce, the print tip mass will stop moving and the counterforce will prevail, driving the movable members apart. This will occur at the point of maximum platen deformation.

Now consider the kinetic system of the present invention, wherein the print tip is accelerated into the platen. It may either have a finite velocity of zero velocity at its moment of arrival. Then, as the accelerating print tip begins to exert a force on the deforming platen, it experiences the platen restoring counterforce. Initially the print tip deforming force will be greater than the platen restoring counterforce. However, unlike the previous example, the print tip force equals the platen restoring counterforce at the mid-point (not at the end) of its excursion. From that point, to the point of maximum deformation, the print tip's momentum will continue to carry it forward, while the greater counterforce is decelerating it. At the point of maximum deformation, all the print tip kinetic energy will have been converted to potential energy in the platen and the restoring force will begin to drive the print tip out.

We find that it is only necessary to apply half of the platen deforming force while the system momentum, in effect, applies the remaining half. We also find that since the hammer mass would have a longer excursion, if we want to limit penetration to the same amplitude, we must shorten the dwell time for the same penetration. Since, as stated above, the mass relates inversely to the square of the frequency, doubling the frequency allows us to reduce the mass by one-quarter.

Typical values in our unique impact printer are: an effective hammer mass at the point of contact of 3 pounds (1350 grams) a contact period of 4 to 6 milliseconds, and a contact velocity of 2 to 3 inches per second (ips). By comparison, typical values of these parameters in a conventional impact printer are: a hammer mass of 3 to 4 grams, a contact period of 50 to 100 microseconds, and a contact velocity of 80 to 100 ips. Even the IBM balltype print element, the heaviest conventional impact print hammer, and its associated driving mechanism has an effective mass of only 50 grams.

We believe that a printer utilzing our principal of operation would begin to observe noise reduction benefits at the following parametric limits: an effective mass at the point of contact of 0.5 pounds, a contact period of 1 millisecond, and a contact velocity of 16 ips. Of course, these values would not yield optimum results, but there is a reasonable expectation that a printer constructed to these values would have some attributes of the present inention and will be quieter than conventional printers. For example, one would not obtain a 30 dB (1000×) advantage, but may obtain a 3 dB (2×) noise reduction. The further these values move toward the typical values of our printer, the quieter the printer will become.

BRIEF DESCRIPTION OF THE DRAWINGS

The advantages of the present invention will be understood by those skilled in the art through the following detailed description when taken in conjunction with the accompanying drawings, in which.

DETAILED DESCRIPTION OF THE ILLUSTRATED EMBODIMENT

Figure 1:
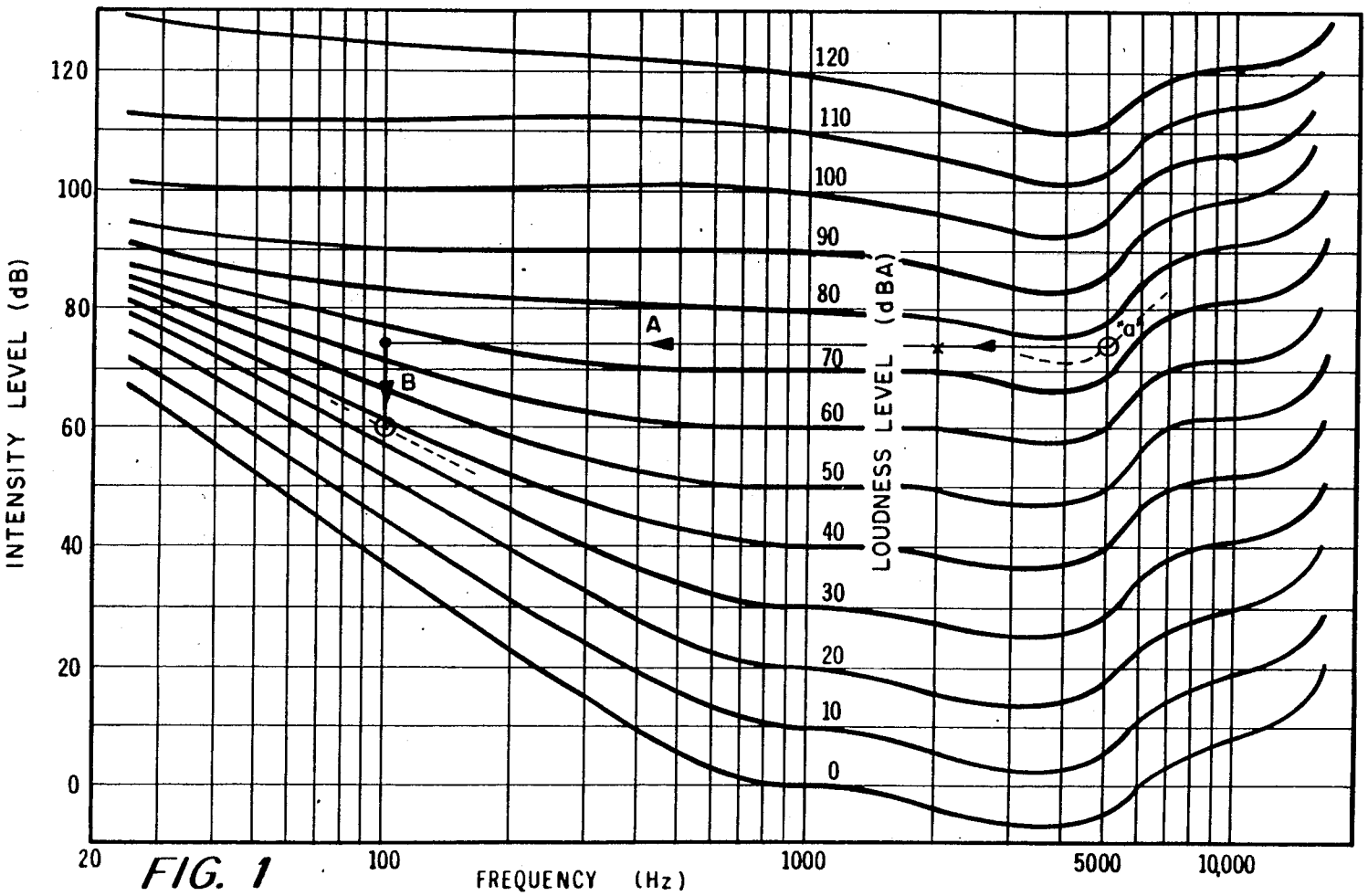
FIG. 1 is a graph showing contour lines of equal loudness for the normal human ear.
Figure 2:
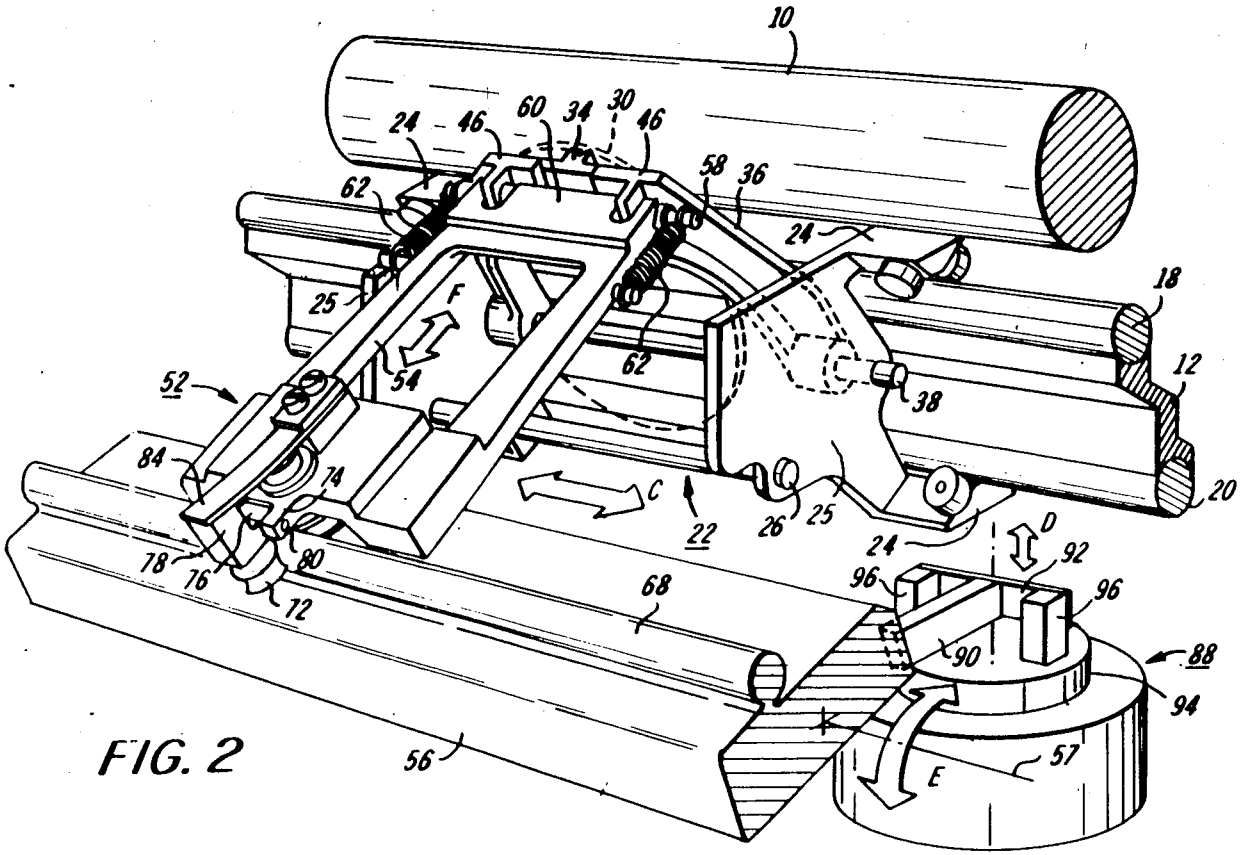
FIG. 2 is a perspective view of the novel impact printer of the present invention.
Figure 3:
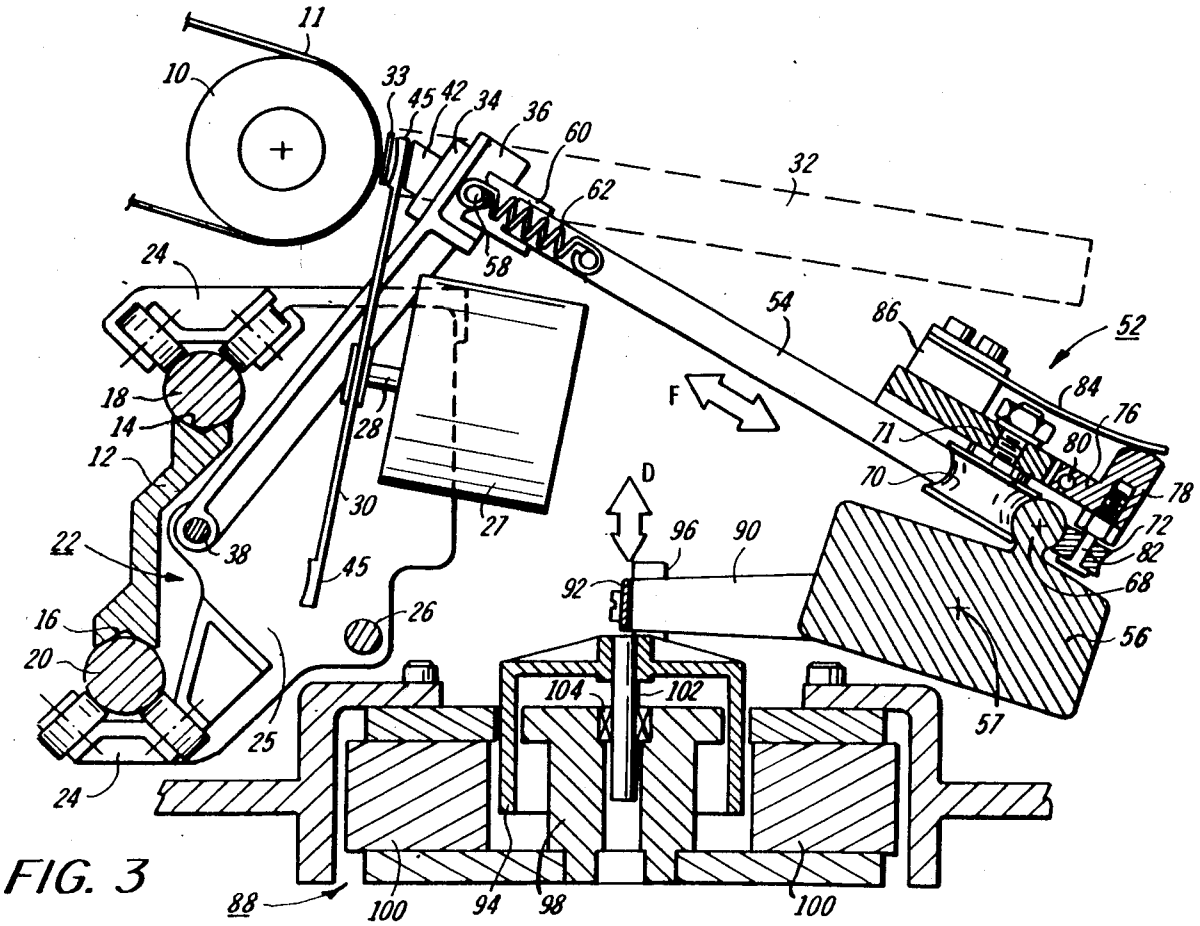
FIG. 3 is a side elevation view of the novel impact printer of the present invention showing the print tip spaced from the platen.
Figure 4:
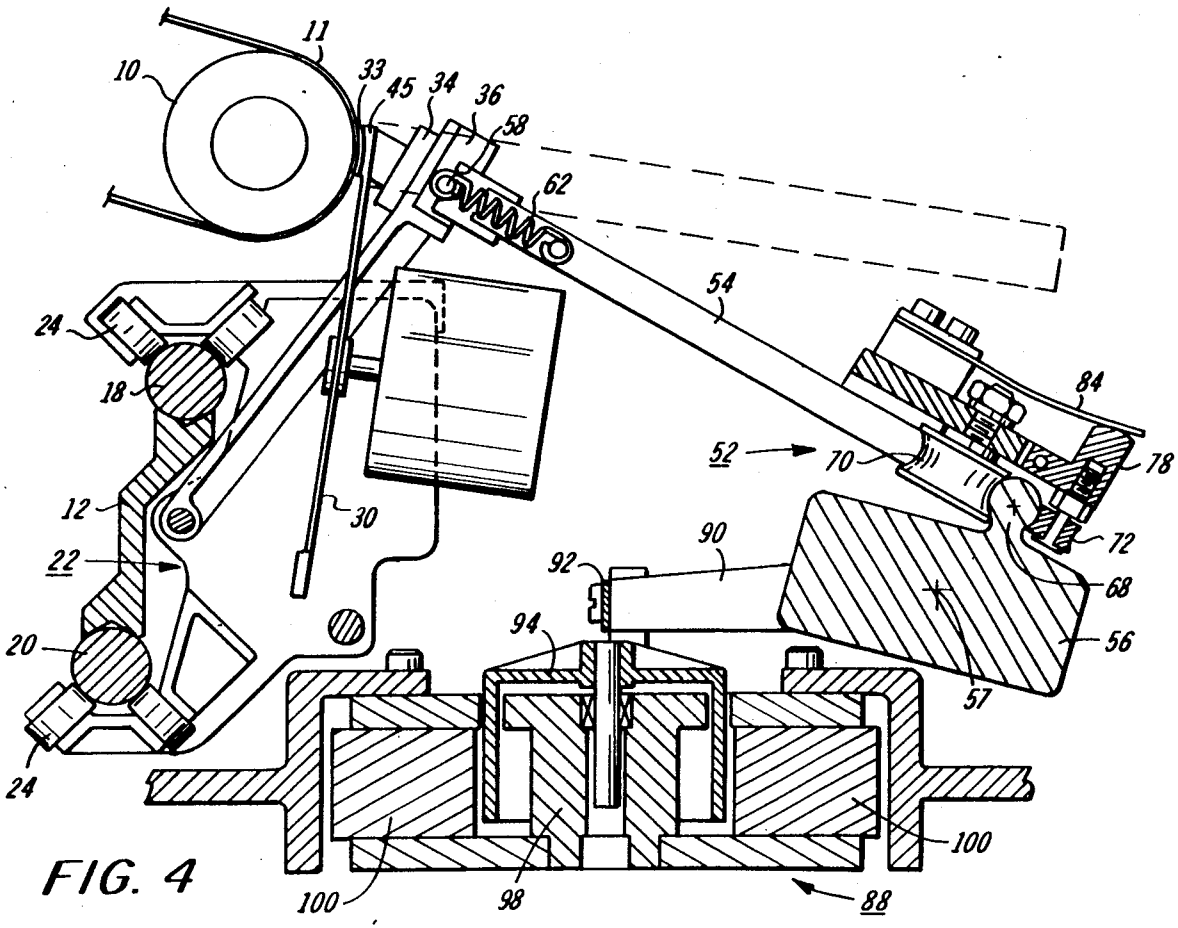
FIG. 4 is a side elevation view similar to FIG. 3 showing the print tip impacting the platen.
Figure 5:
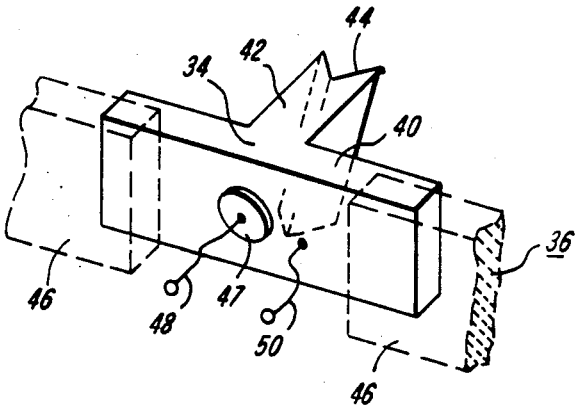
FIG. 5 is an enlarged perspective view of the back of the print tip.

The graph of FIG. 1 has been discussed above with reference to the theory of noise reduction incorporated in the present invention. Our novel impact printer will be described with particular reference to FIGS. 2 through 5. The illustrated printer includes a platen 10 comparable to those used in conventional impact printers. It is suitably mounted for rotation in bearings in a frame (not shown) and is connected to a drive mechanism (also not shown) for advancing and retracting a sheet 11 upon which characters may be imprinted. A carriage support bar 12 spans the printer from side to side beneath the platen. It may be fabricated integrally with the base and frame or may be rigidly secured in place. The carriage support bar is formed with upper and low V-shaped seats 14 and 16 in which rod stock rails 18 and 20 are seated and secured. In this manner, it is possible to form a carriage rail structure having a very smooth low friction surface while maintaining relatively low cost.

It is important that the support bar 12 extends parallel to the axis of the platen so that the carriage 22 and the printing elements carried thereon will be accurately located in all lateral positions of the carriage, along the length of the platen. A cantilever support arrangement for the carriage is provided by four sets of toed-in rollers 24, two at the top and two at the bottom, which ride upon the rails 18 and 20. In this manner, the carriage is unobtrusively supported for moving several motors and other control mechanisms for lateral movement relative to the platen. A suitable carriage drive arrangement (not shown) such as a conventional cable, belt or screw drive may be connected to the carriage for moving it parallel to the platen 10 upon the support bar 12, in the direction of arrow C.

The carriage 22 is shown as comprising side plates 25 secured together by connecting rods 26 and supporting the toed-in rollers outboard thereof. Although the presently preferred form is somewhat differently configured, this representation has been made merely to more easily illustrate the relationship of parts. There is shown mounted on the carriage a printwheel motor 27 having a rotatable shaft 28 to which printwheel 30 is securable, and a ribbon cartridge 32 (shown in phantom lines) which supports a marking ribbon 33 intermediate the printwheel and the image receptor sheet 11. A ribbon drive motor and a ribbon shifting mechanism, which are also carried on the carriage, are not shown.

In conventional printers the carriage also supports the hammer and its actuating mechanism. In our unique arrangement, the carriage only supports a portion of the hammer mechanism, namely, a T-shaped print tip 34 secured upon an interposer member 36. The interposer is in the form of a yoke whose ends are pivotably mounted in carriage 22 on bearing pin 38 so as to be constrained for arcuate movement toward and away from the platen 10. The print tip 34 includes a base 40 and a central, outwardly extending, impact portion 42 having a V-groove 44 in its striking surface for mating with V-shaped protrusions on the rear surface of printwheel character pads 45. Thus, upon impact, the mating V-shaped surfaces will provide fine alignment for the characters by moving the flexible spokes either left or right as needed for accurate placement of the character impression upon the print line of the receptor sheet 11. The outer end of the base 40 are secured to mounting pads 46 of the interposer 36, for leaving the central portion of base unsupported. A strain sensor 47 is secured to the central portion of the base directly opposite the impact portion 42. Suitable electric output leads 48 and 50 are connected to the sensor and the print tip base, respectively, for relaying electrical signals, generated by the sensor, to the control circuitry of the printer. Preferably, the sensor comprises a piezoelectric wafer adhered to the base. It is well known that the piezo electric crystal will generate an electric signal thereacross when subject to a strain caused by a stress. Thus, as soon as the impact portion 42 of the print tip pushed the character pad 45, the ribbon 33 and the image receptor sheet 11 against the deformable platen 10, the platen counterforce acting through the impact portion, will cause the beam of the print tip base 40 to bend, generating a voltage across the piezoelectric crystal strain sensor 47 and sending an electrical signal to the control circuitry 106, indicative of the moment of arrival of the print tip at the platen surface.

The remainder of the hammer force applying mechanism for moving the print tip comprises a mass transformer 52, remotely positioned from the carriage. It includes a push-rod 54 extending between the interposer 36 and a rockable bail bar 56 which rocks about an axis 57 extending parallel to the axis of the platen 10. As the bail is rocked toward and away from the platen, the push-rod moves the interposer in an arc about bearing pin 38, urging the print tip 34 toward and away from the platen. A bearing pin 58 mounted on the upper end of the interposer 36, provides a seat for the V-shaped driving end 60 of the push-rod 54. The two bearing surfaces 58 and 60 are urged into intimate contact by springs 62. At the opposite, driven end 64 of the push-rod, there is provided a resilient connection with an elongated driving surface of the bail bar, in the form of an integral bead 68. The bead is formed parallel to the rocking axis 57 of the bail. One side of the bead provides a transverse bearing surface for a first push-rod wheel 70, journalled for rotation on a pin 71 secured to the push rod. The opposite side of the bead provides a transverse bearing surface for a second push-rod wheel 72, spring biased thereagainst for insuring that the first wheel intimately contacts the bead. The aforementioned biasing is effected by providing the driven end of the push-rod with a clevis 74 to receive the tongue 76 of pivot block 78, held in place by clevis pin 80. The second wheel 72 is supported upon bearing pin 82 anchored in the pivot block. A leaf spring 84 cantilever mounted on a block 86 urges the pivot block 78 to bias the second wheel 72 against the bead 68 and effecting intimate contact of the first push-rod wheel 70 against the bail bar bead 68.

Rocking of the bail bar about its axis 57 is accomplished by a prime mover, such as voice coil motor 88 through lever arm 90 secured to a flexure connector 92 mounted atop movable coil wound bobbin 94 on mounting formations 96. The voice coil motor includes a central magnetically permeable core 98 and a surrounding concentric magnet 100 for driving bobbin 94 axially upon support shaft 102 guided in bushing 104 in response to the current passed through the coil windings. The voice coil motor 88 is securely mounted on the base of the printer. Suitable electronic logic and circuitry, represented by the controller 106, is connected to the voice coil motor for energizing it in the proper sequence and at the proper magnitudes to move the print tip to the surface of the platen and then to deform the platen over the desired velocity trajectory.

The operation will now be described. Upon receiving a signal to initiate an impact current is passed through the coil wound bobbin 94 in one direction for drawing it downwardly in the direction of arrow D and for pulling lever arm 90 to rock bail bar 56 about its axis 57 in the direction of arrow E. Rocking movement of the bail bar causes bead 68 to drive pushrod 54 toward the platen 10, in the direction of arrow F. Since the push-rod is maintained in intimate contact with the interposer 36, the motion of the push-rod is transmitted to the print tip 34 which is driven to impact the deformable platen. As the carriage 22 is moved laterally across the printer, in the direction of arrow C, by its drive arrangement, the push-rod is likewise carried laterally across the printer between the interposer and the bail bar with driving contact being maintained by the spring biased wheels 70 and 72 straddling the bead rail. Conversely, when current is passed through the coil wound bobbin 94 in the opposite direction, it will be urged upwardly in the direction of arrow D for drawing the print tip away from the platen.

It can be seen that the magnitude of the effective mass of the print tip 34, when it contacts the platen 10, is based primarily upon the momentum of the heavy bail bar 56 which has been set in motion by voice coil motor 88. The kinetic energy of the moving bail bar is transferred to the platen through the print tip, during the dwell or contact period, in which the platen is deformed and wherein it is stored as potential energy. By extending the length of the contact period and substantially increasing the effective mass of the print tip, we are able to achieve impact noise reduction of about 1000-fold, relative to conventional impact printers, in the manner described above.

Movement of the print tip is effected as described. By accurately controlling the timing of energization of the voice coil through suitable control circuitry, the voice coile motor may be driven at the desired speed for the desired time, so as to impart kinetic energy to the print tip. Thus, appropriate amounts of kinetic energy may be metered out prior to the contct or both prior to the contact and after contact. For example, a first large drive pulse may accelerate the bail bar and the print tip with sufficient kinetic energy to cause the print tip to cross the 50 mil throat distance and deform the platen by the desired amount (about 5 mil). Alternatively, an incremental drive pulse may merely meter out sufficient kinetic energy to accelerate the print tip across the throat distance through a preselected velocity profile which could cause the print tip to reach the platen with some predetermined velocity of may substantially arrest the print tip at the surface of the platen (compensating, of course, for the interposed character pad, ribbon and paper). As described above, the moment of arrival of the print tip at the platen is indicated by the signal emanating from the piezoelectric sensor 46. Subsequent to that signal, an additional application of kinetic energy may be provided by the voice coil motor to accelerate the print tip into the deformable platen surface to a desired distance and for a desired dwell time so as to cause the marking impression to be made. The application of force at the time of contact enables contact to be made at a lower velocity (generating less noise) than that which would have been needed if there were no opportunity for subsequent acceleration.

CONCLUSION

It should be understood that the present disclosure has been made only by way of example and that numerous changes in details of construction and the combination and arrangement of parts may be resorted to without departing from the true spirit and the scope of the invention as hereinafter claimed.

What is claimed is:

1. An impact printer including a platen, selectable character elements, an impacting element movable toward and away from said platen, and means for driving said impacting element to impart a printing force to a selected character element, to drive it to deform said platen, said printer being characterized by:

said impacting element including sensor means thereon for generating a signal indicative of the initiation of said deformation, and said means for driving comprising force applying means responsive to said signal for accelerating said impacting element to cause said deformation.

2. The impact printer as recited in claim 1 characterized by said impacting element comprising a base supported at its end and unsupported between its ends, and an impact portion extending outwardly substantially perpendicularly from the central unsupported portion of said base, so that as said base begins to deflect, upon initiation of said deformation, said sensor means generates said signal.

3. The impact printer as recited in claim 2 characterized in that said sensor means is mounted upon said base on the side opposite said impact portion and comprises a strain indicating transducer.

4. The impact printer as recited in claim 3 characterized in that said transducer comprises a piezoelectric wafer.

* * * * *